United States Patent [19]

Sabel

[11] Patent Number: 4,481,752

[45] Date of Patent: Nov. 13, 1984

[54] ROTARY CASE LOADING MACHINE

[76] Inventor: Herbert J. Sabel, 543 Avenue Del Oro, Sonoma, Calif. 95476

[21] Appl. No.: 432,965

[22] Filed: Oct. 5, 1982

[51] Int. Cl.[3] ..... B65B 5/06

[52] U.S. Cl. ..... 53/448; 53/473; 53/543; 53/242

[58] Field of Search ..... 53/458, 448, 467, 242, 53/543, 255, 260

[56] References Cited

U.S. PATENT DOCUMENTS

| | | | |
|---|---|---|---|
| 3,751,872 | 8/1973 | Helms | 53/242 X |
| 3,842,571 | 10/1974 | Focke et al. | 53/242 X |
| 3,923,144 | 12/1975 | Langen | 53/543 X |
| 4,179,866 | 12/1979 | Graham et al. | 53/242 X |

*Primary Examiner*—Horace M. Culver

*Attorney, Agent, or Firm*—Owen, Wickersham & Erickson

[57] ABSTRACT

A method and a machine for loading articles into cases utilize indexed rotary movement of a carousel device having a series of angularly spaced platforms, with a case holding device directly above each platform. Articles are pushed onto one of the platforms at an infeed station, in the configuration they will take when packed, with an open-bottomed case held directly above. Then the platform and empty case are rotated to an offloading station, and the platform is raised up into the bottom of the case by camming action, in response to the rotation. At the offloading station, flap folders push the minor bottom flaps of the carton up into closed position, and the case is pushed off the platform onto a conveyor, which also effects closure of the leading major flap up against the minor flaps. There may be three stations, the cases being drawn from flattened, stored configuration and gripped by the case holding device at a station following the offloading station.

22 Claims, 9 Drawing Figures

ROTARY CASE LOADING MACHINE

BACKGROUND OF THE INVENTION

The invention relates to packaging machines, and more particularly to a machine for rapidly and automatically loading articles into folding cartons or cases.

In the packaging industry, various machines have been used for loading products vertically into top opening boxes or horizontally from one side or an end. However, there are disadvantages in top loading of products, wherein the products are often dropped a short distance into the container and are subject to damage. When side or end loading of a standard top opening carton is used, the product must be on their sides during loading, before they are turned to the normal upright position, and this could be injurious to the products being packed.

My earlier U.S. Pat. No. 3,605,377 disclosed a method and an automatic machine for loading a plurality of articles up into the bottom of a carton or case. In that system, the plurality of articles, in their proper pack pattern, were pushed onto a lifting platform and moved up into the case on the platform, whereupon a pair of the bottom flaps were closed, under the platform. Then the loaded case was pushed off the platform onto a surface, in a direction parallel to the converged edges of the closed bottom flaps, thereby closing a third flap. From there, further operations closed the last bottom flap and the top flaps, and the case was sealed.

It is a general object of the present invention to improve on the system of my earlier patent by greatly increasing the speed at which cases can be loaded using, generally, the bottom loading procedure of that earlier patent. This object is achieved by use of a special rotating carousel-type loading device, which raises and lowers a series of angularly spaced apart platforms by a camming action, in response to rotation of the carousel.

SUMMARY OF THE INVENTION

According to the case loading method of the present invention, a plurality of articles at an infeed station, positioned in the configuration they are to be as packed, are fed onto a platform of a rotary carousel loading device, while an open-bottomed case is held above the platform, by a case holding means on the carousel. The carousel is then rotated to move the platform to an offloading station, while converging the platform and the open-bottomed case vertically toward one another, such that the platform with the articles is moved fully into position in the case. Then a pair of bottom flaps of the case, i.e. the minor flaps, are folded up against the bottom of the platform, with a central pedestal attached to the bottom of the platform positioned between the folded-up flaps, and the loaded case is moved off the platform onto a surface at the same level, such as a conveyor surface, such that the platform slides out of the case with the articles retained inside. This movement onto the adjacent surface pushes a leading, unfolded bottom flap up into the folded position, into contact with the minor flaps. The loaded case is then conveyed to further operations for completion of closure and sealing of the case.

Preferably, the convergence of the open-bottomed case and the platform is effected by raising the platform into the case, and this is preferably controlled by a camming action responsive to the rotation of the carousel.

There may be four platforms spaced 90° apart on the carousel, with a case holding means directly above each platform. The system may accordingly include four stations, the infeed station and the offloading station, which may be 180° apart; an inactive intermediate station following the infeed station, where no special operation is performed but the articles are partially loaded into the bottom of the case; and a case-storage and pickup station, where the cases are opened up from a flattened, stored condition and gripped by the case holding means, preliminarily to advancement of the case and platform to the infeed station.

Other objects, advantages, features and characteristics of the invention will be apparent from the following description of a preferred embodiment, considered along with the accompanying drawings.

DESCRIPTION OF PREFERRED EMBODIMENT

Figure 1:
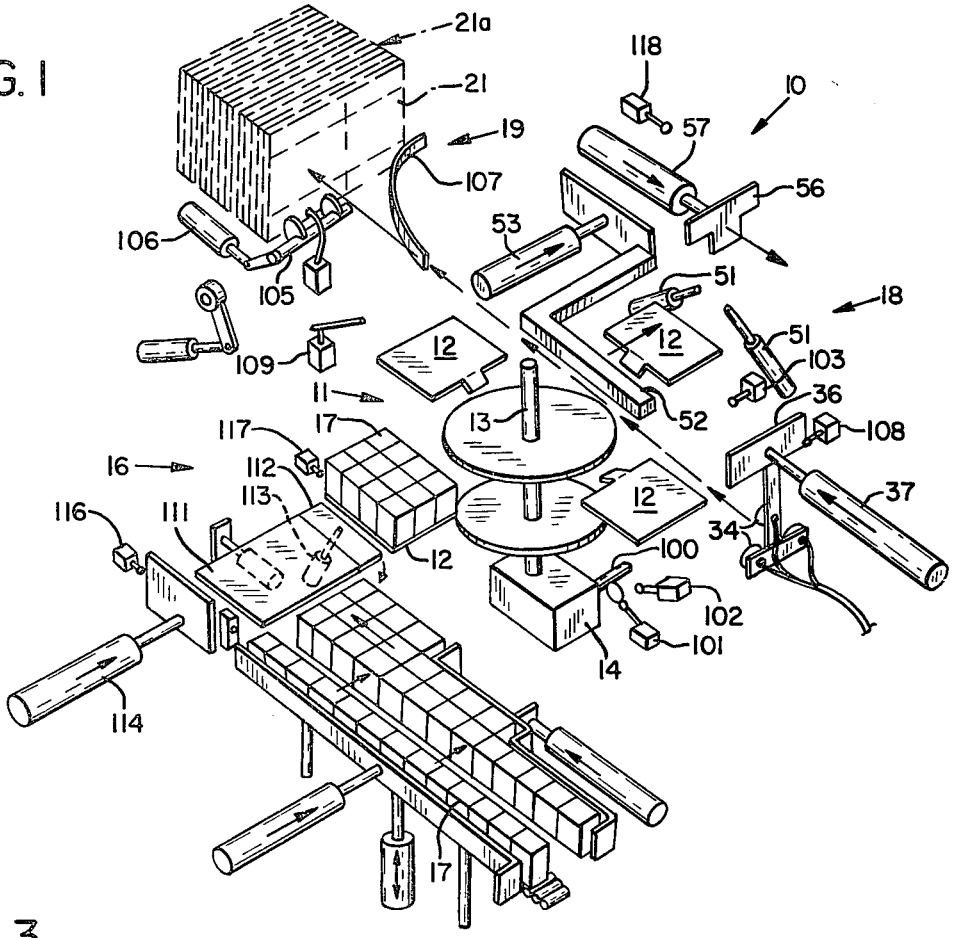
FIG. 1 is a schematic view in perspective showing some operative components of a case loading machine of the present invention, indicating the feeding of articles onto one of four elevator platforms at an infeed station, the platform being part of an indexed rotatable carousel.

In the drawings, FIG. 1 shows schematically a rotary case packing assembly 10, only certain principal components being illustrated, for clarity. The machine includes a rotational carousel 11 with a series of vertically reciprocable elevator platforms 12, the carousel assembly being rotatable on a central vertical shaft 13 driven by an indexing drive unit 14 at the base of the assembly 10. The drive unit 14 may be, for example, a Camco No. 901 RDM-4-H32-330 with R250 reducer and 1 H.P. D.C. motor, manufactured by Emerson Electric Company of Farmington, Conn.

The case packing assembly 10 includes a plurality of stations for performing operations involving the carousel 11. At an infeed station 16, articles 17 are loaded onto an adjacent elevator platform 12. As the carousel 11 rotates, the elevator platform 12 is caused to rise, loading the articles into an empty case from the bottom (not shown in FIG. 1), and at an offloading station 18, the loaded case leaves the carousel. At a carton storage and pickup station 19, an empty case 21 is opened from the flattened position in a stack 22 and held on the carousel, directly above an elevator platform 12, ready for advancement to the infeed station 16 where the assembled articles 17 are loaded. All of these operations and the components involved will be described further in reference to FIGS. 2–9, as well as FIG. 1.

Figure 3:
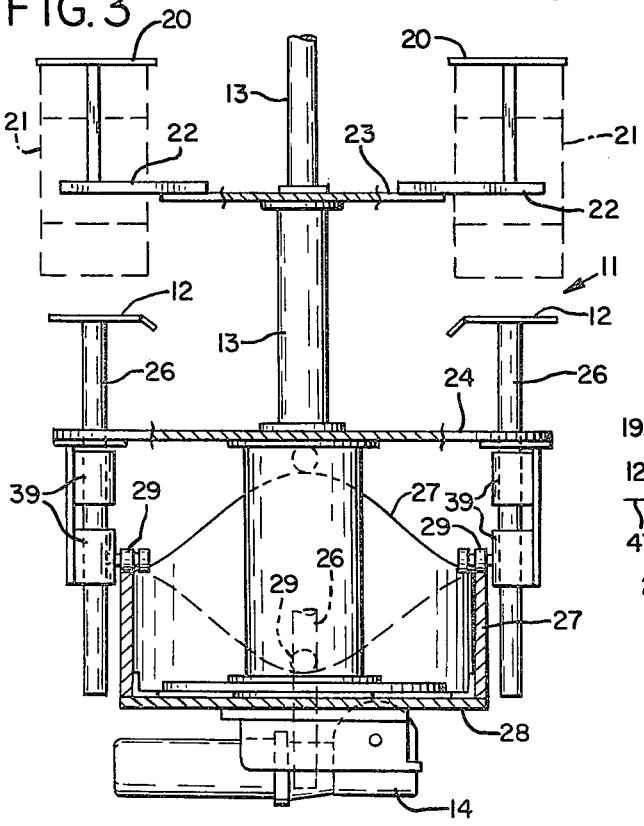
FIG. 3 is an elevation view in section showing the carousel with the elevator platforms following the cam surface and case gripping arms, rotational with the carousel above the platforms.
Figure 2:
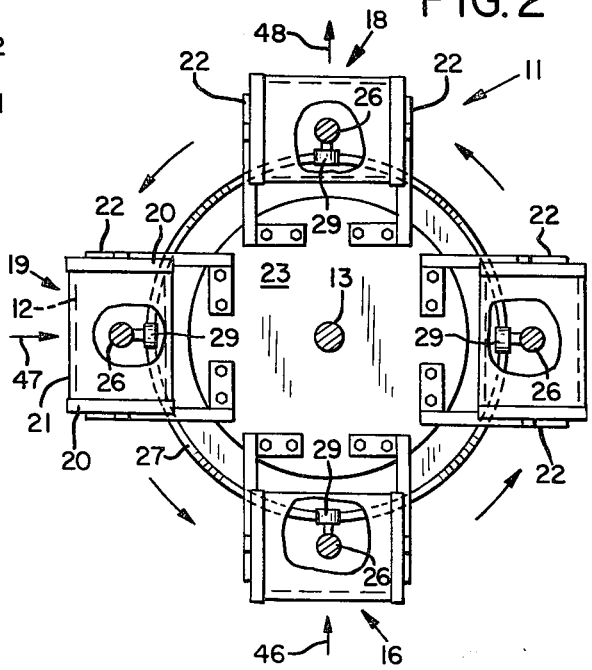
FIG. 2 is a plan view taken from a position lower than the top of the machine, showing major components of the rotary carousel of the machine, the four elevator platforms being moved up and down by a ring cam in response to rotation, each elevator assembly having a cam follower which rides on the upper edge of the ring cam.

FIGS. 2 and 3 show the carousel 11 with carton-gripping arms 22 positioned above each platform 12. The arms 22 are connected to the central rotatable shaft 13 of the carousel, and this may be by a plate-like structure 23 as shown, secured to the shaft 13. Each pair of arms 22 preferably also includes a pair of top hold-down plates 20 secured to the arms as indicated in FIG. 3, to provide a positive stop against upward movement of the carton 21 as articles on the platform 12 are moved up into it. In FIG. 2 the holddown plates 20 are shown only at the case pickup station 19, for clarity.

At a lower level on the carousel 11, a table-like disc 24, also fixed to and rotatable with the central driven shaft 13, supports the elevator platforms 12 on pedestals or stems 26 which interact with a cylindrical ring cam 27 which is fixed to a base 28 and non-rotatable. As indicated, the ring cam 27 has an upper surface which varies in height around its circumference, with smooth, curving transition between levels. Each platform stem 26 supports a cam follower 29, preferably a wheel which rolls on the top surface of the ring cam 27, to effect the raising and lowering of the platform 12 in its travel with the carousel.

As illustrated in FIGS. 2 and 3, each pair of case-gripping arms 22 is permanently positioned above a platform 12, so that a case 21 is held directly above a platform 12. In FIGS. 2 and 3, only key elements are shown, with more details of the carton-gripping arms 22 and the reciprocable platforms 12 shown in FIGS. 4, 6 and 7.

Figure 4:
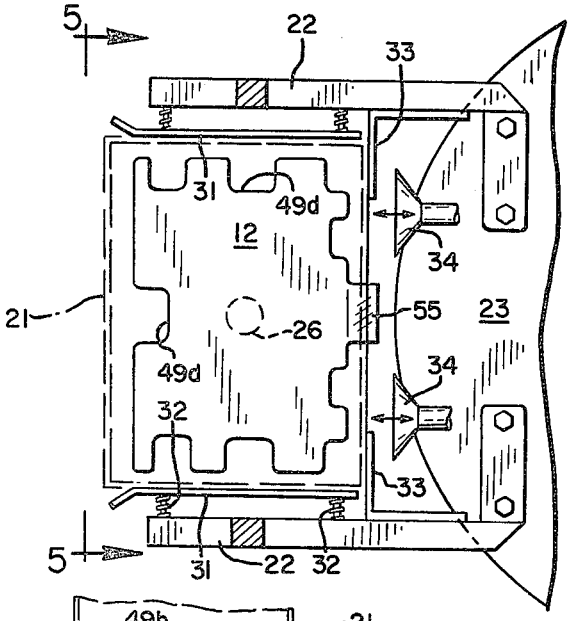
FIG. 4 is a plan view of a portion of the machine, showing a pair of the gripping arms holding an empty, open-ended case, the case having been drawn there by a pair of suction cups.
Figure 5:
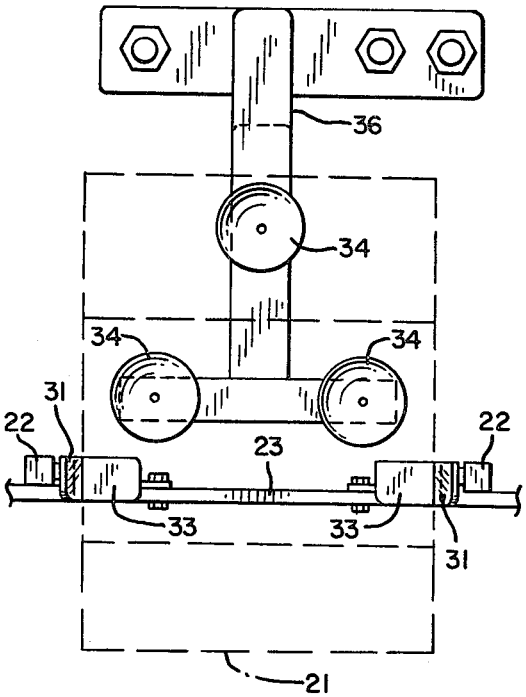
FIG. 5 is an elevation view of the suction cup device, a viewed along the line 5—5 in FIG. 4, indicating its position with respect to an empty case to be drawn into the gripping arms.

FIG. 4 shows in greater detail one of the pairs of case-gripping arms 22, which extend from the rotatable structure 23 and preferably include pressure bars 31 at least one of which is urged inwardly by springs 32 to grip the case 21 at predetermined pressure. Position stops 33 secured to the arms 22 assure that the carton 21 is in precisely the proper position, drawn there by suction cups 34 attached to a reciprocating frame 36 shown in FIG. 5. The suction cups 34, positioned to engage the empty case as indicated in FIG. 5, apply active suction to the case panel to grip it positively and pull the case into position between the pressure bars 31 by retraction of the suction cup frame 36. As shown in FIG. 1, the frame 36 is actuated by a fluid cylinder 37 (the frame 36 is actually positioned closer to the stack 22 of flattened cartons, on the other side of the carousel's central shaft 13, but in FIG. 1 is shown further removed, for clarity).

Figure 6:
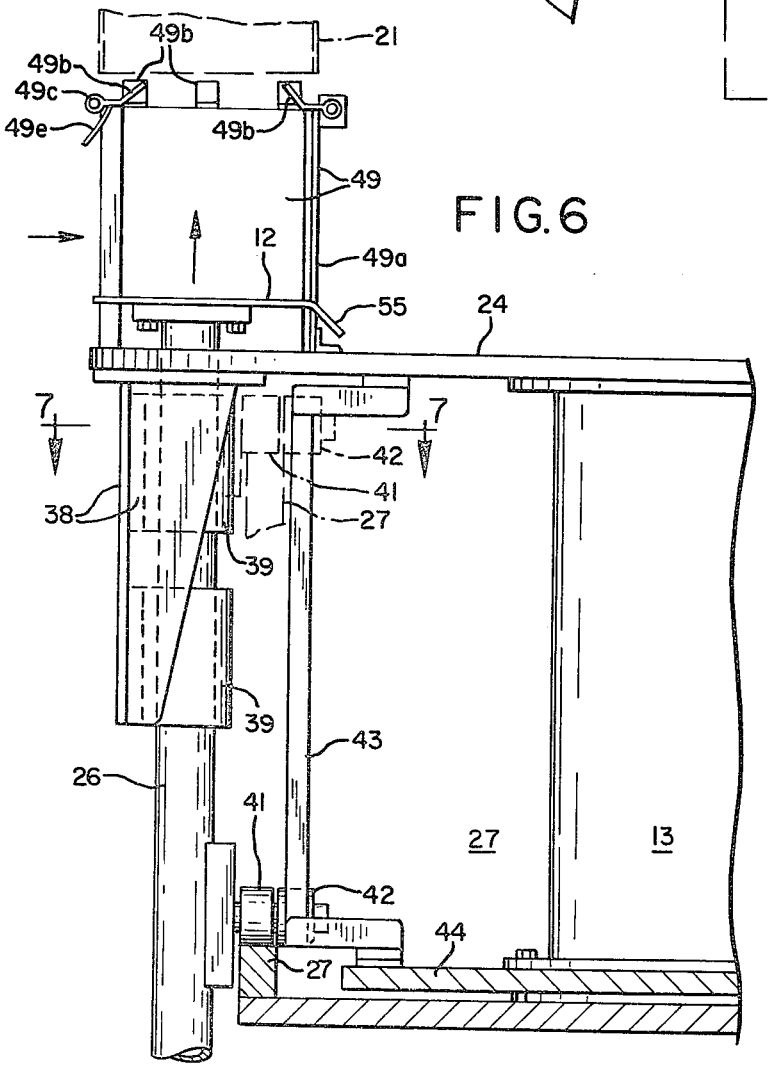
FIG. 6 is an elevation view in section of a portion of the machine, indicating a lower portion of the carousel where an elevator platform has a reciprocable pedestal or stem which follows the surface of the ring cam as the carousel rotates.
Figure 7:
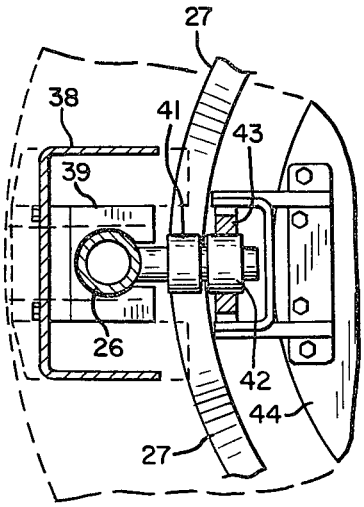
FIG. 7 is a sectional view of a portion of the machine, taken along line 7—7 in FIG. 6, illustrating the elevator stem and cam follower apparatus.

FIGS. 6 and 7 show in greater detail the camming mechanism for raising and lowering the elevator platforms 12. Each platform 12 is supported on its pedestal or stem 26, which is mounted for vertical reciprocation with respect to the rotatable table structure 24. A stem mounting and stabilizing structure 38 is secured to and extends downwardly from the table or plate 24, with bearings or guides 39 within which the stem 26 is movable. Connected to the pedestal is a cam follower 41 in the form of a roller which rolls along the top edge of the ring cam 27, as illustrated. This effects the vertical reciprocation of the platforms 12 as the carousel rotates, achieving the correct level for the platform at each station as the carousel is indexed. The sides of the bearings 39 which face the ring cam 27 are open so that the cam follower 41 can travel up to its maximum-height position, as indicated in FIG. 7 and in dashed lines in FIG. 6.

For stability of the pedestal or stem 26 and the platform 12, and to prevent rotation of them with respect to the table 24 as the carousel is indexed, there is included on each stem a second roller 42, mounted along with the cam follower roller 41 but for separate rotation. This roller 42 travels in a vertical track 43 to assure stability and fixed orientation of the stem 26 and platform 12. As illustrated in FIGS. 6 and 7, the roller track 43 is connected at its bottom to a bottom disc or plate 44, also rotatable with the central shaft 13 and the table 24 above. At its top end, the roller shaft 43 is secured to the bottom of the table 24.

Figure 8:
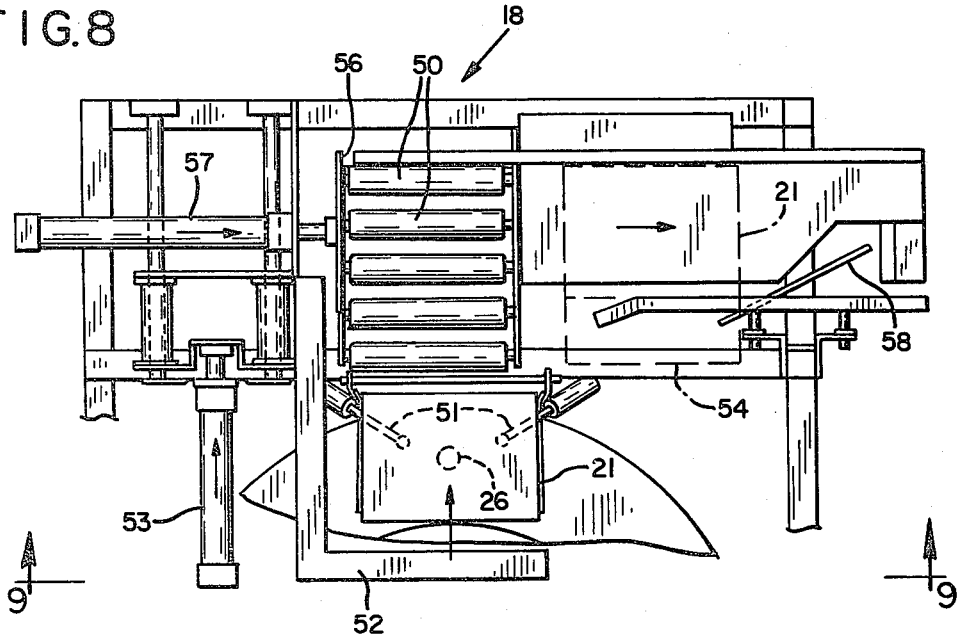
FIG. 8 is a plan view of a portion of the machine at an offloading station which may be opposite the infeed station, illustrating a filled case as it is pushed off the carousel platform onto rollers at the same level, with bottom minor flaps of the case held closed by extendable pushers.
Figure 9:
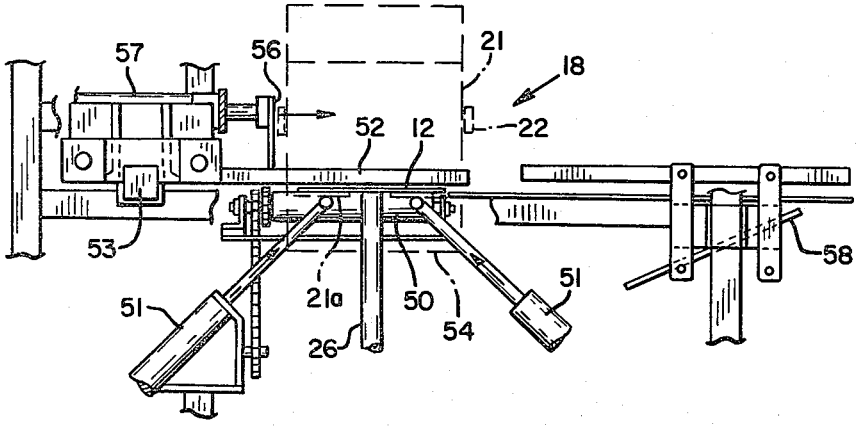
FIG. 9 is a view in elevation, viewed along the line 9—9 in FIG. 8, showing the same offloading operation.

Referring again to FIGS. 1 and 2, the articles 17 are loaded onto a platform 12 of the carousel at the infeed station 16, with an empty case 21 held directly thereabove, having been picked up at the case storage station 19 just previously. FIG. 2 indicates the infeed of articles at the station 16 by an arrow 46, and the picking up and positioning of an empty case 21 into the arms 22 at the case storage station 19, by an arrow 47. As the carousel is indexed twice, through 180°, the platform 12 with the articles is cammed upwardly, fully into the carton by the time it reaches the offloading station 18. There, as indicated by an arrow 48 in FIG. 2, the loaded carton is removed from the plaform 12 and leaves the carousel. FIGS. 8 and 9 illustrate the operation at the offloading station 18.

To assure that the articles 17 enter the case 21 properly, without catching on any edges at the bottom of the open case, an enclosure structure 49 shown in FIG. 6 preferably is included, secured to the table structure 24 at each elevator platform 12, at three sides of the platform. In FIG. 6 two sides of the enclosure 49 are shown, on the left and at the back of the platform (as viewed, for example, from the infeed station 16). A downwardly angled flap guide 55 at the back of the platform 12 (see FIGS. 4 and 6) extends through the back portion 49*a* of the enclosure, there being a vertical opening in the back 49*a* for that purpose. The right side of the enclosure 49 is not seen in FIG. 6. Further aiding the proper insertion of the articles up into the case 21 are series of pivotal guide tabs 49*b* mounted at the top edges of the enclosure 49, and also one at the front as indicated, connected to a bar 49*c* which spans between the two sides of the enclosure 49 at the front. These tabs 49*b* pivot upwardly when the articles on the platform move up into the case 21. The tabs 49*b* pivot up into engagement with the inside surfaces of the case's depending bottom flaps to assure that the articles travel smoothly into the case. In FIG. 4 recesses 49*d* are shown in the platform 12, for permitting the platform 12 to descend past the tabs 49*b* on its way back down, since the tabs 49*d* will then have fallen back to their inwardly-extending position shown in FIG. 6. For small articles to be loaded, the recesses 49*d* in the platforms often must be eliminated so that articles do not fall through, and in that situation the pivotal tabs 49*b* can be powered to be in the up position when the platform 12 returns back down past them. The enclosure structure 49 may also include an angled guide 49*e* connected to the spanning bar 49*c* at the front, for assuring the products enter the case properly.

The plan view of FIG. 8 and the elevation view of FIG. 9 illustrate a carton 21 at the offloading station 18, the carton now being filled with articles and still having the platform 12 inside, at the same level as or slightly higher than a set of rollers 50. When the carton 21 has reached this point, fluid-actuated flap-folding pushers 51 at each side and below the carton extend to push bottom side flaps, preferably minor flaps 21*a* of the carton, up into the closed position, against the bottom of the platform. As indicated in FIG. 9, the stem 26 of the platform is positioned between the edges of the bottom minor flaps 21*a* at this point, permitting sliding movement of the carton parallel to those flap edges. The loaded carton 21 may then be removed from the platform by a pushing hook 52, as shown in FIGS. 8 and 9, onto the rollers 50. The pushing hook 52 is moved by a fluid cylinder 53. Movement of the carton onto the rollers causing a leading bottom flap of the carton (not seen in FIGS. 8 and 9), i.e. the depending flap closest to the rollers 50, to be pushed upwardly to the closed position, against the minor flaps. Thus, as the loaded carton rolls onto the rollers 50, only the trailing bottom flap 54 is still extended cammed up by the flap guide 55 of the platform (FIGS. 4 and 6) and by the horizontal surface of the platform 12 itself to an outward horizontal position. This is seen in FIG. 8, where the carton 21 and the open bottom flap 54 are seen in dashed lines, after having been removed from the rollers 50 by another fluid-actuated pusher 56 operated by a cylinder 57.

In FIG. 8 the case gripping arms 22 are not shown, but their position is indicated in dashed lines in FIG. 9. They are above the level of the pusher hook 52.

After the loaded carton reaches the dashed-line position shown in FIG. 8, it is conveyed to further operations wherein the last bottom flap 54 is folded upwardly and closed, which may be by an inclined rail 58 along its path of travel, then the top flaps of the carton are closed, and the flaps are sealed. Those operations do not form a part of this invention.

It should be understood that although the case loading apparatus of the invention is illustrated and described herein with a four-position carousel, and with three operative stations and one inoperative station spaced 90° apart, fewer stations and carousel positions could be used if desired. For example, in some situations it would be possible to have the carton storage and pickup station 19 combined at the same position as the article infeed station 16, the stack 22 of cartons being positioned above the article infeed. Then the carousel could have only two platforms and pairs of carton-holding arms, with only two positions indexed for the carousel: article and carton infeed; and offloading. However, it has been found that a smoother operation is possible, and higher speed, using a four-position carousel, while affording more space for the various operative components, storage of cartons, etc.

Also, although the apparatus is described and shown with the ring cam 27 effecting up and down movement of the elevator platforms, it is also possible for the platforms 12 to remain at one constant level, with the carton holding arms moving downwardly to bring the carton over the articles on the platform. For reasons of space and the desired location of major working components at a low level, the illustrated arrangement of raising the platform and articles up into the case is preferred.

The sequence of operation of the rotary case packing assembly 10 will now be described, with reference to various position-sensing limit switches and fluid-actuated cylinders indicated in FIG. 1. The discussion refers to FIG. 1 except where otherwise indicated. The interconnection of the various limit switches, fluid cylinders, etc. is by apparatus well known to those skilled in the art, and does not form a part of the present invention.

At start up, the indexer 14 begins to rotate, removing pressure against a limit switch 101 which may interact with a cam on a shaft 100 of the indexer 14, the shaft 100 and cam being included in the Camco indexer referenced above. The shaft 100 may be geared to rotate one full revolution for each 90° of rotation of the carousel. The indexer 14 stops when the limit switch 101 is reengaged.

As the indexer 14 transfers the platforms 12 and other associated apparatus from one station to the next, another limit switch 102 is actuated momentarily as the platforms approach their stop points. This starts, slightly in advance of full stoppage of the carousel, the operations at the case pickup station 19 and the offloading station 18, as well as at the infeed station 16, provided other limit switches at the stations sense that everything is in place for these operations.

When the switch 102 is actuated, the case opening cylinder 37 at the case pickup station 19 is actuated to extend the frame 36 with the suction cups 34. The suction cups move toward the stack 22 of flattened cases 21, and when the suction frame 36 is extended far enough to reach the first carton 21 in the stack 22, a limit switch 103 is tripped, stopping further extension of the cylinder 37 and causing vacuum to be applied to the suction cups 34, while also causing case-holding stops 105 to be opened by an actuating cylinder 106. After a short time delay the case opening cylinder 37 retracts, pulling with it a case 21. The case is opened by contact with a fixed curved rail 107, and deposited into the arms 22 with their spring loaded pressure bars 31, as shown in FIG. 4. Another limit switch 108 is actuated as the case opening cylinder 37 approaches full retraction, causing the vacuum to the suction cups to be shut off and the case holding stops 105 to be closed.

The positioning of the open case in the arms 22 actuates a switch 109, which insures that a case is open and positioned correctly.

Meanwhile, at the infeed station 16, product articles have been accumulating adjacent to the elevator platform, as indicated in FIG. 1. They are advanced onto an adjacent table 111, and a hinge plate 112 is pivoted up by a cylinder 113, bridging the gap between the accumulated product and the platform 12. A product push off cylinder 114 extends, leaving a switch 116, and the accumulated articles 17 are transferred onto the elevator platform 12 (and into the enclosure 49 shown in FIG. 6) beneath an open case. A limit switch 117 is actuated at the end of the stroke of the pusher cylinder 114, and that cylinder retracts and the hinge plate 112 pivots down. More product is accumulated on the table 111 of the infeed station.

At the offloading station 18, operations are performed simulatneously with those described for the carton pickup station 19 and the product infeed station 16. As described above with reference to FIGS. 8 and 9, the bottom flap folding pushers 51 extend to fold the minor flaps of the carton upwardly. After a short time delay, the pusher hook cylinder 53 extends to discharge the filled case onto the rollers 50 shown in FIG. 8, which preferably are powered to quickly draw the case off the carousel and put it into position for further operations. This folds up the leading bottom major flap, as described above.

When a switch 118 is actuated by the pusher hook assembly, the hook cylinder 53 retracts and the bottom flap folding pushers 51 retract. The powered rollers 50 and the case pusher 56 and cylinder 57 (FIG. 8 and FIG. 1) move the filled case to the sealing section.

To start the next index of the carousel, the following conditions must exist to assure that all stations have completed operation:

(1) The case opening cylinder 37 must be retracted, with the limit switch 108 engaged. An opened case must be detected in position on the carousel at the case pickup station 19, with the limit switch 109 engaged.

(2) The limit switch 117 at the product infeed station 16 must have been engaged momentarily, indicating that product has been deposited onto an elevator platform 12 at that station.

(3) The limit switch 118 at the offloading station 18 must have been engaged momentarily, indicating that the filled case was discharged at that station.

When all these conditions have been made, the indexer 14 will rotate the carousel, leaving the limit switch 101. As the carousel rotates through 90° the limit switch 102 will be actuated, restarting all of the above-described operations. Re-engagement of the limit switch 101 causes the indexer to stop at the next position.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. A method for loading articles into a case, comprising:

at an infeed station, feeding a plurality of articles, assembled in the configuration they are to be in when loaded in the case, onto a platform of a rotary carousel loading device, while holding an open-bottomed case with a case holding means on the carousel, above the platform;

rotating the carousel to move the platform to an offloading station while converging the platform and the open-bottomed case vertically toward one another such that the platform with the articles is moved fully into position in the case;

folding up bottom minor flaps of the case, against the bottom of the platform, with a central pedestal at the bottom of the platform positioned between the folded-up minor flaps;

moving the loaded case off the platform onto a surface at the same level, such that the platform slides out of the case with the articles retained inside, and thereby folding up a leading bottom major flap, into contact with the minor flaps; and conveying the loaded case to further operations for completion of closure and sealing of the case.

2. The method of claim 1, wherein the platform and the open-bottomed case are converged together by raising the platform into the case.

3. The method of claim 1, wherein the rotary carousel has a plurality of angularly spaced apart platforms, each having a case holding means above, and wherein cases are withdrawn in flattened condition from case-storage station, opened into rectangular forms and gripped by case holding means at the case-storage station, while articles are being fed onto the platform at the infeed station and while articles contained in another case are at the offloading station.

4. The method of claim 3, wherein four platforms and case holding means are provided, at 90° separation.

5. The method of claim 3, wherein the platforms are cammed up and down in response to rotation of the carousel, between a lowermost position at the infeed station and an uppermost position at the offloading station.

6. The method of claim 1, wherein the plurality of articles, in assembled configuration, are pushed onto the platform by a pusher moving linearally in the direction of the platform, generally radially with respect to the carousel, and wherein, after the articles are pushed into the platform, another plurality of articles are pushed into position at the infeed station by movement at right angles to the direction of movement of the first plurality of articles onto the platform.

7. The method of claim 1, wherein the bottom minor flaps are folded up at the offloading station by a pair of fluid-actuated pushers, and held up while the loaded case is pushed off the platform onto said surface.

8. A machine for loading articles into cases, comprising:

a rotary carousel loading device with means for indexed driving of the device about a vertical axis, the loading device having a plurality of platforms spaced angularly apart, and a case holding means above each platform;

an infeed station adjacent to the carousel with means for feeding a plurality of articles, assembled in the configuration they are to be when loaded in the case, onto a platform of the rotary carousel loading device;

means for opening a case from a stack of flattened cases, each case having top flaps and bottom flaps, and feeding the opened case to the case holding means, with the bottom flaps open, to be held above a platform;

means associated with the indexed driving means for rotating the carousel with the articles on the platform, and with the open-bottomed case above, to the offloading station while converging the platform and the open-bottomed case vertically toward one another such that the platform with the articles is moved fully into position in the case;

flap folding means at the offloading station for pushing a pair of bottom flaps of the case up into folded, closed position, against the bottom of the platform, the platform having a central supporting stem at its bottom positioned between the converged edges of the folded-up flaps; and means for moving the loaded case off the platform onto a surface at the offloading station, said surface being at the same level as the platform at the offloading station, so that the platform slides out of the case with the articles retained inside and a third, unfolded bottom flap is folded up into contact with the folded flap by movement onto said surface.

9. The machine of claim 8, wherein the converging means comprises means for raising the platform into the case.

10. The machine of claim 9, wherein the converging means includes means for camming the platforms up and down in their rotary travel, in response to rotation of the carousel.

11. The machine of claim 10, wherein the camming means comprises a cylindrical cam positioned concentrically with the rotational axis of the carousel, having an upper camming edge the height of which varies with respect to rotational position around the carousel, with smooth curving transitions in the camming surface, and cam follower means connected to the platforms for effecting the up and down movement of the platforms as the carousel is rotated.

12. The machine of claim 8, wherein the feeding means at the infeed station comprises means for pushing the plurality of articles onto the platform.

13. The machine of claim 8, wherein the carousel loading device includes four platforms, spaced 90° apart.

14. The machine of claim 8, wherein the flap folding means includes pneumatically actuated pushers at the offloading station.

15. The machine of claim 8, wherein the case feeding means and the stack of flattened cases are located at a case storage and pickup station following the offloading station, upstream of the infeed station.

16. The machine of claim 15, wherein the carousel loading device includes four platforms spaced 90° apart, the carousel indexed driving means including means for stopping each platform at each of the three stations and at a fourth, inactive station following the infeed station and upstream of the offloading station.

17. A rotary case packing machine, comprising:

a rotary carousel having a central vertical shaft, with indexed driving means for rotating the shaft and carousel incrementally;

at least two platforms mounted on the carousel at regularly spaced apart locations, each supported on a generally vertical stem extending downwardly, for holding a plurality of articles to be packed in a case;

case gripping means on the carousel, above each platform, for holding an empty case, with open bottom flaps, directly above the platform;

case pickup means for loading empty cases into the case gripping means;

an infeed station adjacent to the carousel and means for moving the plurality of articles onto one of the carousel platforms at the infeed station;

means associated with the carousel for converging the platform and the case gripping means toward one another in response to rotation of the carousel as the platform with the articles moves away from the infeed station until the articles and the platform are inside the case; and an offloading station adjacent to the carousel for removal of the loaded case from the carousel when it arrives there, with flap folding means at the offloading station for pushing minor bottom flaps of the case up into the folded, closed position against the bottom of the platform on which the articles are positioned, with the platform's stem between the minor flaps, and case moving means for sliding the loaded case off the platform onto a surface at substantially the same level at the offloading station, so that a leading major flap is pushed up to the closed position against the minor flaps by movement onto said surface.

18. The rotary case packing machine of claim 17, wherein the means for converging the platform and the case gripping means comprises a ring cam positioned concentrically with respect to the carousel and having an upper surface whose elevation varies between a minimum height at the infeed station and a maximum height at the offloading station, and including cam follower means connected to each platform for raising and lowering each platform in response to rotation of the carousel, following the height variations of the upper surface of the cam between the stations.

19. The rotary case packing machine of claim 18, wherein the cam follower means comprises a slide bearing connected to the carousel and supporting the stem of the platform for vertical sliding movement therein, and a cam follower roller extending from the stem and resting on the upper surface of the cam.

20. The rotary case packing machine claim 19, further including a guide roller extending from the stem, and a vertical track fixed to the carousel, with the guide roller in the track, for stability at the platform and stem in their vertical reciprocation.

21. The rotary case packing machine claim 20, wherein a common shaft secured to the stem supports both the cam follower roller and the guide roller.

22. The rotary case packing machine claim 17, wherein the case pickup means comprises a horizontally reciprocable frame with suction cups connected to vacuum means, positioned adjacent to the carousel, a fluid cylinder connected to the frame to extend and retract the frame and suction cups, a stack of flattened cases in vertical orientation being adjacent to the carousel, the frame being positioned to extend to the flattened cases, engage one and pull it into the case gripping means on the carousel on retraction of the frame.

* * * * *